United States Patent [19]

Notz

[11] 4,170,743

[45] Oct. 9, 1979

[54] HIGH-CURRENT, LOW PRESSURE, MERCURY DISCHARGE LAMP WITH PRESSURE COMPENSATION SPACE

[75] Inventor: Hans Notz, Dietikon, Switzerland

[73] Assignee: BBC Brown, Boveri & Company Limited, Baden, Switzerland

[21] Appl. No.: 918,428

[22] Filed: Jun. 23, 1978

[30] Foreign Application Priority Data

Apr. 5, 1978 [DE] Fed. Rep. of Germany ..... 2814683

[51] Int. Cl.[2] ..... H01J 61/067; H01J 61/10; H01J 61/20; H01J 61/30

[52] U.S. Cl. ..... 313/204; 313/217; 313/220

[58] Field of Search ..... 313/220, 204, 205, 207, 313/217

[56] References Cited

U.S. PATENT DOCUMENTS

| | | | |
|---|---|---|---|
| 2,332,189 | 10/1943 | Arnold et al. | 313/204 |
| 3,262,004 | 7/1966 | Keller | 313/205 X |
| 3,585,436 | 6/1971 | Beijer et al. | 313/207 X |
| 3,971,968 | 7/1976 | Bachmann et al. | 313/220 X |
| 4,000,431 | 12/1976 | Brandli et al. | 313/220 X |

FOREIGN PATENT DOCUMENTS 642460 5/1927 France .

*Primary Examiner*—Palmer C. Demeo
*Attorney, Agent, or Firm*—Oblon, Fisher, Spivak, McClelland & Maier

[57] ABSTRACT

A heavy-current mercury low-pressure lamp with pressure equalization space, wherein the anode and cathode electrodes are arranged one behind the other in a bulb and wherein the one of the two arms of the discharge space projects coaxially into the bulb and passes through the annular-shaped anode. The arm of the discharge space which projects into the bulb extends at least as far as the cathode and surrounds the latter laterally. Arc-through through the pressure compensation space is prevented and the average useful life of such lamps is thereby prolonged.

3 Claims, 2 Drawing Figures

HIGH-CURRENT, LOW PRESSURE, MERCURY DISCHARGE LAMP WITH PRESSURE COMPENSATION SPACE

BACKGROUND OF THE INVENTION

The invention relates to a heavy-current mercury low-pressure lamp with pressure equalisation space, wherein the anode and cathode electrodes are arranged one behind the other in a bulb and wherein the one of the two arms of the discharge space projects coaxially into the bulb and passes through the annular-shaped anode.

Lamps of this type are known from DE-OS 25 15 607 and are used preferably as ultra-violet radiation sources, e.g., for the sterilisation of foodstuffs. In the practical use of these lamps it has been discovered that is is possible for a direct arc-through to occur between cathode and anode through the pressure equalisation space, and that this possibly causes the destruction of the entire lamp. The cause of this arc-through lies in the unduly high temperature of the pressure equalisation space, the shape of which, in the known lamps, is determined substantially by two collar-shaped parts. The high temperature in the pressure compensation space of these lamps is the result of this space being heated by the radiation of the cathode. Heating also occurs by the anode column of the discharge.

SUMMARY OF THE INVENTION

Accordingly, it is an object of the present invention to disclose a heavy-current mercury low-pressure lamp of the type initially mentioned, wherein an arc-through through the pressure compensation space is prevented and the average useful life of such lamps is thereby prolonged.

This and other objects are achieved according to the invention in that the arm of the discharge space which projects into the bulb extends at least as far as the cathode and surrounds the latter laterally.

Two objects are achieved by these measured. Firstly the pressure compensation space is removed for a considerable part into the cold zone of the cathode space and therefore permits better cooling. Secondly this construction makes possible a longer pressure compensation space compared to known lamps (as to the influence of the length of the pressure compensation space on arc-through of., also CH-PS 578 250).

BRIEF DESCRIPTION OF THE DRAWINGS

A more complete appreciation of the invention any many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
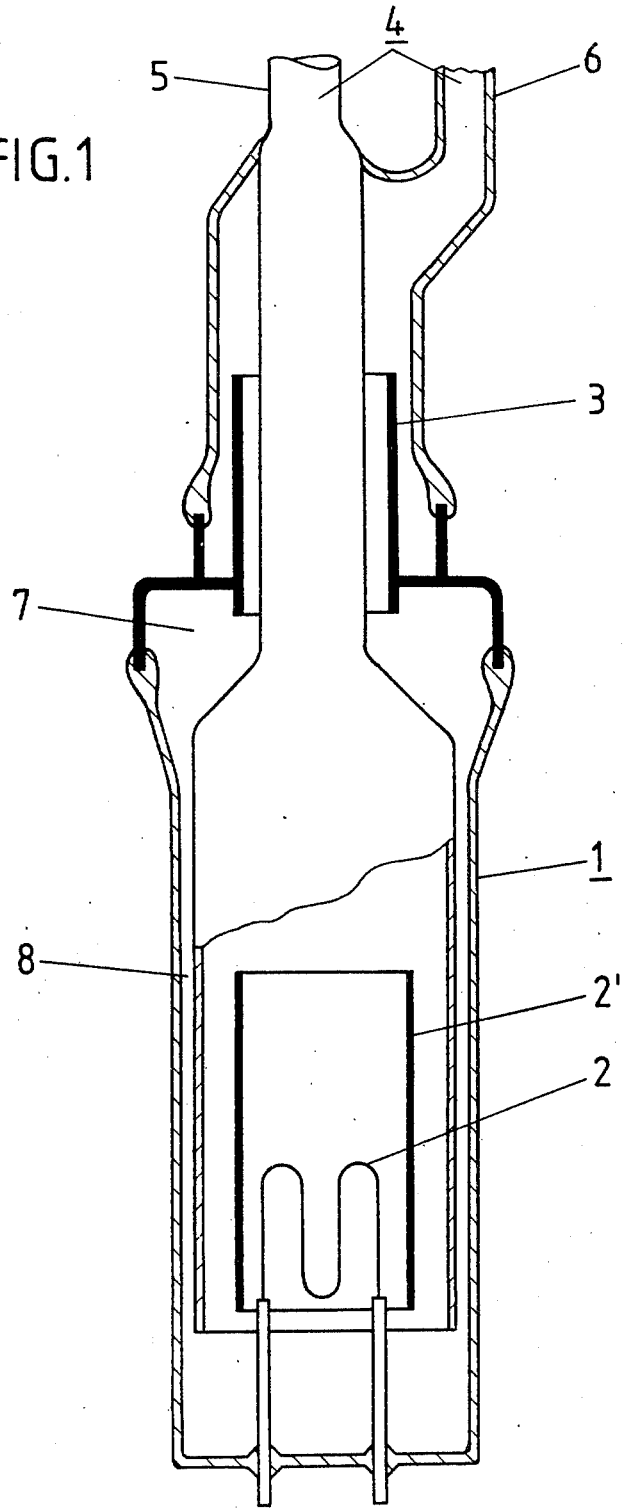
FIG. 1 shows a heavy-current low-pressure lamp in accordance with this invention.

Referring now to the drawings, wherein like reference numerals designate identical or corresponding parts throughout the several views, and more particularly to FIG. 1 thereof. FIG. 1 shows a bulb 1 made substantially of heat-resistant hard glass, in which the two electrodes, the cathode 2 and the anode 3 are arranged one behind the other. The cathode exhibits, in addition to the actual heating coil, a cylindrical radiation shield 2' which is intended to prevent lateral heat radiation. The discharge space 4 comprises the two arms 5 and 6, both of which are connected to the same end of the bulb 1. The arm 5 projects coaxially into the bulb 1, passes through the annular-shaped anode 3 and, after corrsponding widening in the anode region 7, surrounds the cathode 2.

The interstice 8 between the wall of the bulb 1 and the widened part of the arm 5 constitutes in the entire region an extraordinary strong discharge path protected from arc-through, which additionally makes possible a sufficient gas/vapour stream for the pressure compensation between the anode and cathode parts of the lamp (pressure compensation space), if the distance D between the wall of the bulb 1 and the arm 5 is not less than 0.5 mm. For distances D greater than 4 mm arc-through may occur. In these cases the cathode 2 should be arranged farther in the interior of the arm 5, because then the path between the anode and cathode through the pressure compensation space becomes longer, whereby any possible arc-through is likewise counteracted. Lamps with a distance D of 1 mm have been found particularly successful.

Figure 2:
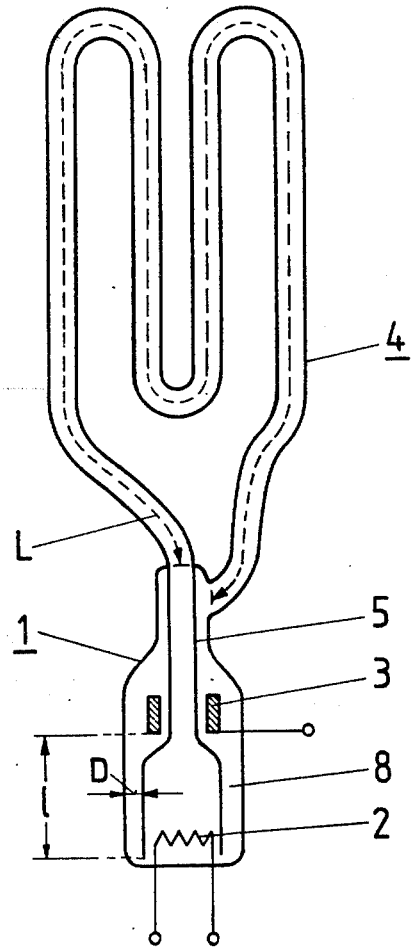
FIG. 2 shows a lamp with meander shape discharge space in accordance with this invention.

In order to ensure satisfactory operation of the lamp, the length 1 of the arm 5 extending into the bulb 1 — measured between the bottom edge of the anode 3 and the bottom edge of the arm 5 — should be approximately 1/5 to 1/20, preferably 1/10 of the length L of the total discharge space located outside the bulb 1. In FIG. 2 the lengths are illustrated for a lamp with meander-shaped discharge space.

The novel construction is easy to produce and has been found to be the best solution for all typesof single-bulb lamps for direct-current operation.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United STates is:

1. A high-current mercury low pressure lamp with a pressure compensation space, comprising:

an envelope having a bulb portion and an arm portion, said arm portion including a part emerging from the bulb portion and a part reentering said bulb portion, said arm portion defining a discharge path and being light transparent;

an annularly shaped anode electrode;

a cathode electorde, said anode and cathode electrodes disposed in tandem within said bulb portion;

wherein the reentering part of said arm portion projects coaxially into said bulb portion and passes through said annularly shaped anode electrode, said reentering part having an open end which extends at least to the cathode electrode to surround the cathode electrode laterally such that said cathode electrode is within said reentering part, said cathode electrode communicating with said anode electrode through said open end of said reentering part and through an intermediate space betwen said bulb portion and said reentering part;

wherein said intermediate space serves as said pressure compensation space.

2. A low-pressure lamp according to claim 1 wherein:

the length of the reentering arm part extending into the bulb measured between the bottom edge of the anode electrode and the bottom edge of the open end of the reentering arm part is approximately 1/5 to 1/20, preferably 1/10, of the total length of the arm portion located outside the bulb portion.

3. A low-pressure lamp according to claim 1, wherein:

the separation distance of the intermediate space between the wall of the bulb portion and the reentering arm part between the anode and cathode electrode is 0.5 to 4 mm, preferably 1 mm.

* * * * *